US006805700B2

(12) United States Patent
Miller

(10) Patent No.: US 6,805,700 B2
(45) Date of Patent: Oct. 19, 2004

(54) PERCUSSIVE THERAPEUTIC DEVICE

(76) Inventor: Edward W. Miller, P.O. Box 535, Salem, OR (US) 97308

( * ) Notice: Subject to any disclaimer, the term of this patent is extended or adjusted under 35 U.S.C. 154(b) by 9 days.

(21) Appl. No.: 10/121,568

(22) Filed: Apr. 12, 2002

(65) Prior Publication Data

US 2003/0195443 A1 Oct. 16, 2003

(51) Int. Cl.[7] ..... A61H 1/00; A61H 23/02

(52) U.S. Cl. ..... 606/239; 601/108; 601/110; 601/111; 606/237; 606/238

(58) Field of Search ..... 601/48, 84, 97, 601/101, 103, 107, 108, 110, 111; 606/237, 238, 239

(56) References Cited

U.S. PATENT DOCUMENTS

| | | | | |
|---|---|---|---|---|
| 1,796,444 A | | 3/1931 | Dell'era et al. | |
| 2,076,410 A | | 4/1937 | McGerry | |
| 2,078,025 A | | 4/1937 | Samuels | |
| 4,088,128 A | | 5/1978 | Mabuchi | |
| 4,549,535 A | | 10/1985 | Wing | |
| 4,566,442 A | * | 1/1986 | Mabuchi et al. | 601/101 |
| 4,716,890 A | | 1/1988 | Bichel | |
| 4,730,605 A | * | 3/1988 | Noble et al. | 601/110 |
| 4,841,955 A | | 6/1989 | Evans et al. | |
| 5,140,979 A | | 8/1992 | Nakasawa | |
| 5,618,315 A | | 4/1997 | Elliott | |
| 5,632,765 A | * | 5/1997 | Holder | 601/108 |
| 5,951,501 A | * | 9/1999 | Griner | 601/108 |
| 6,228,042 B1 | | 5/2001 | Dungan | |
| 6,537,236 B2 | * | 3/2003 | Tucek et al. | 601/80 |

* cited by examiner

*Primary Examiner*—Nicholas D. Lucchesi
*Assistant Examiner*—Quang D. Thanh
(74) *Attorney, Agent, or Firm*—Carl D. Crowell

(57) ABSTRACT

A chiropractic adjustment tool or tapper comprises a housing, the housing having an open end; a impact assembly disposed within the housing and secured thereto. The impact assembly comprises a reciprocating rod with adjustable travel and impact force. An impelling element such as a solenoid is provided to accelerate the reciprocating rod. Disposed on one end of the reciprocating rod is a coupler to permit multiple impact heads to be attached to the tool. The tool is further improved with the addition of a fan unit on a port in the housing and an exit port located on a distal end of the housing, preferably at a location such that air flow is across the impelling element, and any switch or circuitry to provide cooling and extend tool life.

3 Claims, 2 Drawing Sheets

PERCUSSIVE THERAPEUTIC DEVICE

BACKGROUND OF THE INVENTION

The present invention involves the field of medical devices. More particularly, it involves the field of percussive medical devices used as chiropractic adjustment tools used to move bones and relieve muscle spasms and stress.

Percussion is a new treatment modality for those who suffer from musculoskeletal pain and myofascial trigger syndrome. It is a non-surgical, non-invasive procedure that may serve as a therapeutic alternative to trigger point and epidural injections or be used when other treatments have failed. Performed on an outpatient basis, percussive treatment carries little or no risk and is relatively comfortable.

As is well-known in the chiropractic art, the spines or other bones of humans sometimes go out of alignment or are otherwise mis-adjusted. This can lead to discomfort and additional physical symptoms. In such cases an adjustment of the spine or other bone to a healthy alignment can have substantial therapeutic effects.

Several attempts have been made to provide hand-held or other small devices to assist in adjusting a patient's spine or other bone by the use of impacts. However, each of these devices provide limited force, are subject to failure, and have limited application and adjustability.

Needed in the field is a multiple impact device with easily adjustable impact pressure and impact heads. Also needed is a device with increased power, and cooling to extend device life. The present invention is directed to these shortcomings in the prior art.

BRIEF SUMMARY OF THE INVENTION

The present invention provides a chiropractic adjustment tool or tapper, which, generally, comprises a housing, with or without a handle and a motor or power source to drive an axially reciprocating rod. The reciprocating rod is disposed perpendicularly or near perpendicular to the handle. One end of reciprocating rod extends from the housing and on the extended end is a impact head with a coupler for the mounting of one or more impact heads. The other end of the reciprocating rod has a spring pair assembly to permit the ready adjustment of impact force and axial travel of the reciprocating rod.

A fan is affixed to the housing and air is used to cool the device with an inport and an outport on distal ends of the unit requiring air flow to transit heat generating components, including any motor, switches and circuitry.

The operation of the device is with a solenoid, or other motive force driving the reciprocating rod axially. The reciprocating rod is slideably mounted within the housing, transiting through the solenoid coil. The reciprocating rod is held in place by springs, affixed to the reciprocating rod to limit travel and to return the reciprocating rod to the neutral position between impacts. On activation, the reciprocating rod is accelerated axially by the solenoid. Mounted on the extended end of the reciprocating rod is one of a number of impact heads. An impact head is used to impact the patient's body. When the solenoid is reactivated, the reciprocating rod is again accelerated toward the patient's body. A typical rate of impact is twelve impacts per second. Both the speed and the force of impact are adjustable to provide optimal therapeutic effects. In a preferred embodiment, the travel and force of impact of the reciprocating rod is adjusted by adjusting the compression of the spring pair.

Improvement over the prior art is found in the reduction of the mechanical moving parts of the device, the use of the spring pair for adjusting impact force, the improved cooling of the device and the coupler to permit the use of multiple and adjustable impact heads.

Though the device may be used in a manner that provides continuous pressure punctuated by impacts, another improvement over the prior art is the use of an impact assembly that permits an impact head to provide instantaneous force without durational pressure. This is accomplished through the use of an accelerated reciprocating rod that is permitted to bounce or recoil off of the patient, providing impact force without pressure of any duration. This is advantageous as pressure is painful and increases bruising.

For a more complete understanding of the present invention, reference is made to the following detailed description and accompanying drawings. In the drawings, reference numbers refer to like parts through the several views.

DETAILED DESCRIPTION OF THE INVENTION

Figure 1:
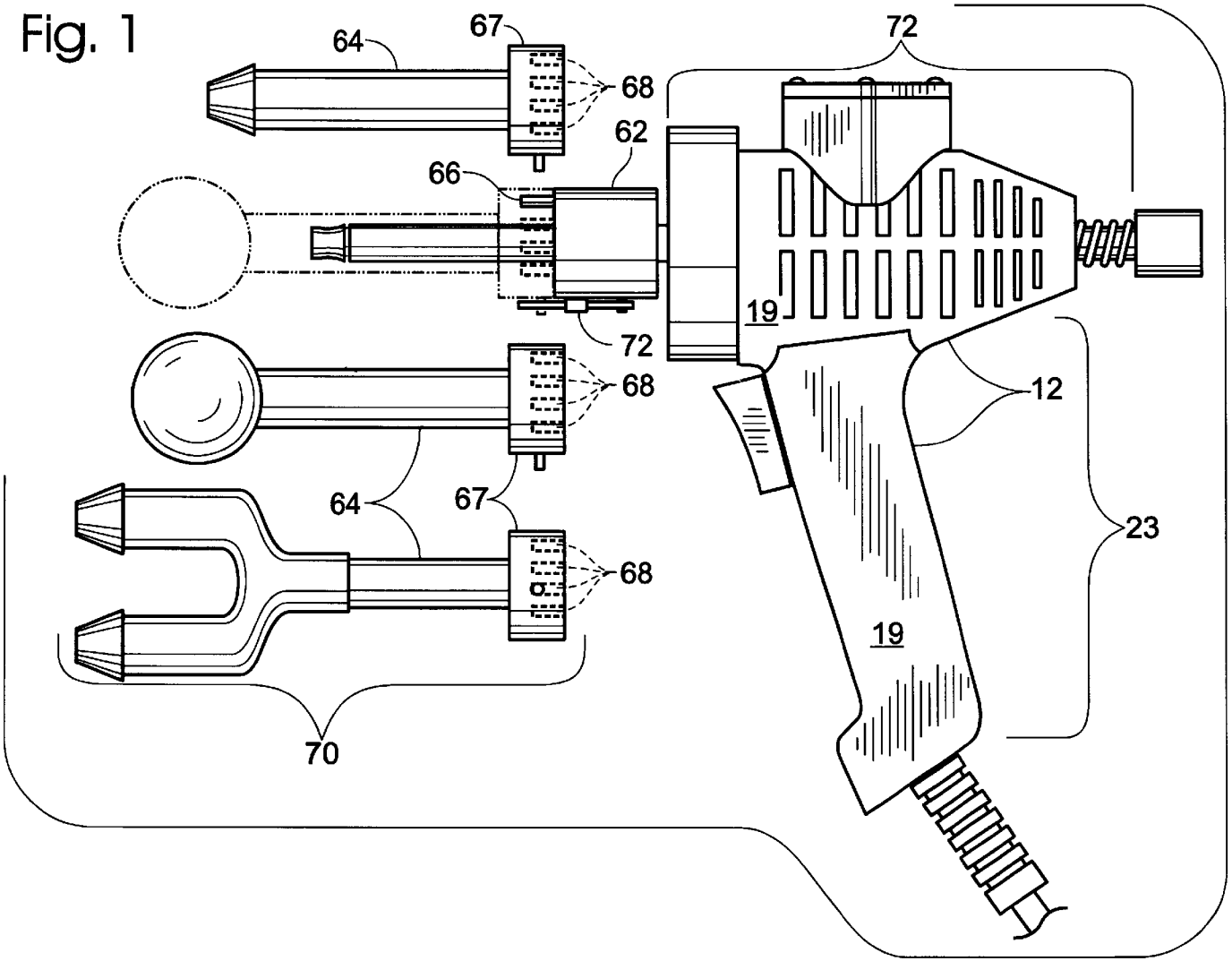
FIG. 1 is an environmental view of an adjusting tool in accordance with the present invention with three different impact heads depicted.
Figures 2, 3:
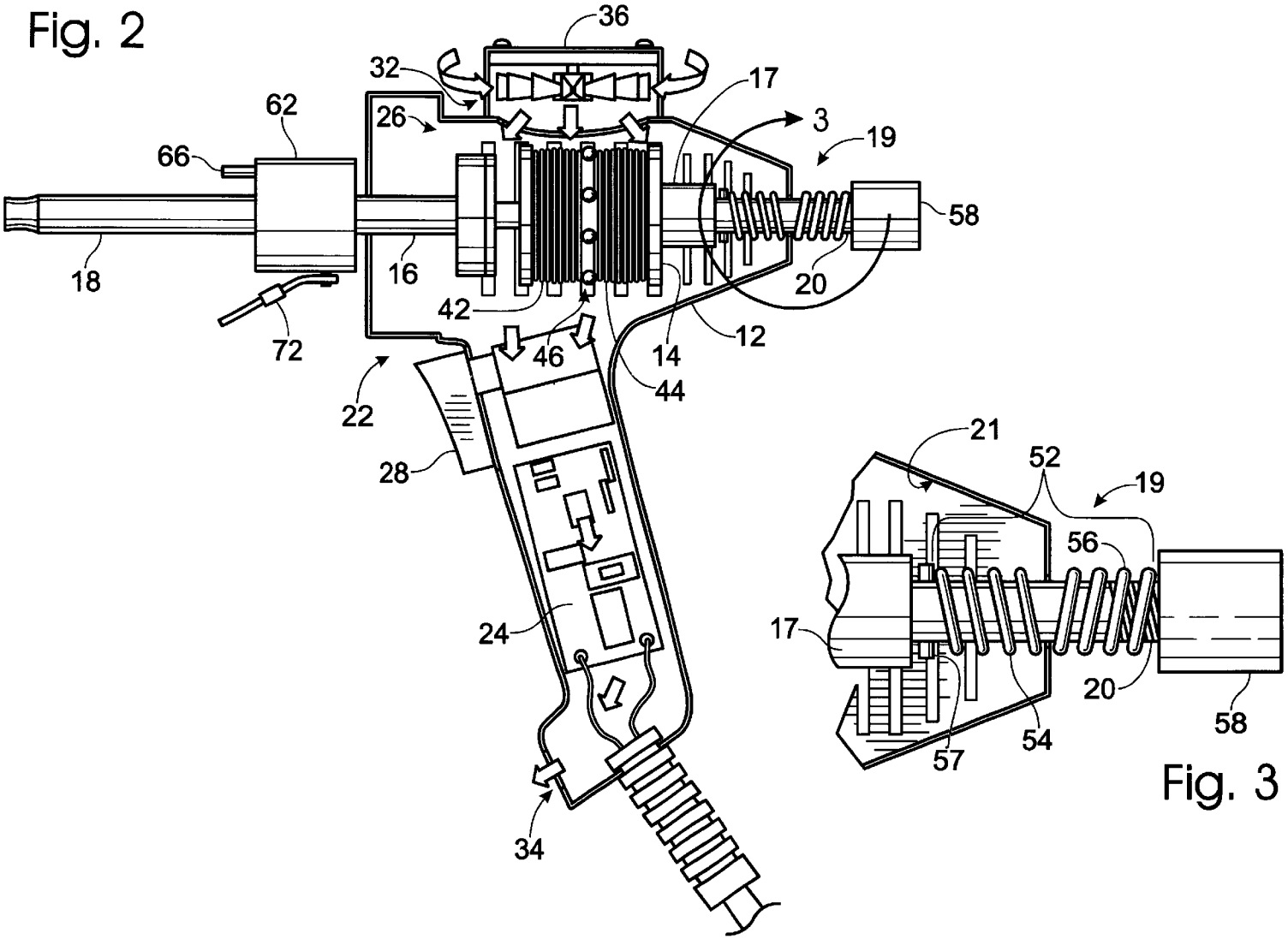
FIG. 2 is a cutaway view of the impact tool depicting air flow.
FIG. 3 is a detail of the spring pair assembly.

Referring to the drawings, there is depicted a chiropractic adjustment tool or tapper in accordance with the present invention, generally denoted at 10. The tapper 10, generally, comprises a housing 12, a impact assembly 26 disposed within the housing, the impact assembly 26 comprising a motive source 14, preferably a solenoid 14, the motive source 14 providing operational power to the impact assembly 26 and a reciprocating rod 16 with an impact head 70 disposed at one end and secured to the reciprocating rod 16 by a coupler. At one end of the housing is an import 32 to permit air flow, and at a distal end, an outport 34 so positioned to permit air flow to transit the elements of the invention needing cooling such as the solenoid 14, switches 28 and any circuitry 24. A fan 36 is provided to increase airflow. Other methods of moving air, including membrane driven pumps may also be used.

The housing 12 is a hollow member having an outer surface 19 and an inner surface 21. The housing 12 is made of any convenient material, such as plastic, metal, or the like. The housing 12 has a handle portion 23 to enable easy grasping and holding of the tapper 10. The housing 12 also has a barrel portion 22 integral with the handle portion 23.

Contained in the barrel portion 22 and affixed thereto is the motive source 14, which in the preferred embodiment is a solenoid 14. An improvement in the present invention is the use of a solenoid 14 with at least two coil elements comprising a first coil 42, and a second coil 44 separated by an airspace 46 to permit improved cooling.

Transiting through the solenoid 14 is a reciprocating rod 16 responsive to the force generated by the solenoid 14 such that on activation the reciprocating rod 16 is accelerated axially.

An electric energy source is operatively connected to a switch 28, preferably mounted in the handle portion 23. The switch 28 is operatively connected to the solenoid 14 so that on activation, the solenoid 14 receives power. The switch 28 may be in any well-known form, including a "trigger" or a "button," either of which plungingly closes the circuit to the power source. In the preferred embodiment, the circuit also contains additional circuitry 24 such as a relay or similar device to automatically activate and deactivate the solenoid 14 at an adjustable rate.

In the preferred embodiment, the reciprocating rod 16 is axially elongated and has a forward first end 18 on which is mounted a collar 62, a medial portion 17 defined by an enlarged diameter portion which receives the motive force from the solenoid 14, and a rearward second end 20 which is preferably threaded. The reciprocating rod 16 transits the barrel portion of the housing and the solenoid 14 contained therein. The reciprocating rod 16 exits two distal ends of the barrel portion of the housing. A coil spring pair 52, placed in series, is disposed around the rearward end 20 of the reciprocating rod 16 with a forward spring 54 and a rearward spring 56.

In the preferred embodiment, the rearward spring 56 is of a heavier gauge than the forward spring 54. The forward spring 54 is disposed around the reciprocating rod 16 and held in place by an adjustable stop 57 placed in the reciprocating rod 16 on the forward end of the forward spring 54 and is biased against the inner surface of the housing 21 on the rearward end of the forward spring 54. The rearward spring 56 disposed around the reciprocating rod 16 is biased against the outer surface of the housing 19 and fitted against a threaded annular head 58.

The threaded annular head 58 is rotatably threaded onto the rearward end 20 of the reciprocating rod 16. In operation the travel and force of the reciprocating rod 16 may be adjusted by tightening the annular head 58 and compressing the spring pair 52. As the rearward spring 56 in the spring pair is heavier than the forward spring 54 of the spring pair, the forward spring 54 is compressed at a greater rate than the rearward spring 56, causing the reciprocating rod 16 to draw back or be displaced towards the rear of the housing. The increased compression of the spring pair 52 and displacement of the reciprocating rod 16 adjusts axial travel of the reciprocating rod 16 when the solenoid 14 is activated. The spring pair 52 also provides the neutral position of the reciprocating rod 16 when not being impelled or accelerated by the solenoid 14, such that on deactivation of the solenoid 14, the reciprocating rod 16 recoils and returns to the neutral position as determined by the spring pair 52. This provides the additional benefit of permitting the impact head 70 to impart force on the patient being treated without pressure of any duration.

In one embodiment, the adjustable stop 57 and the annular head 58 are marked with indicators to permit calibrated adjustments to the compression of the individual springs 54, 56, in the spring pair 52. This may be accomplished by moving the stop 57 to alter the compression of the forward spring 54 against the inner surface of the housing 21 independent of the adjustments of the annular head 58 which principally adjusts the compression of the rearward spring 56. This permits added control over the force imparted by the impact head 70 on the patient, and also permits adjustment of the movement of the reciprocating rod 16, slowing or adjusting the acceleration rate.

In use, the impact head 70 makes contact and imparts force only briefly on activation of the solenoid 14, and then is immediately withdrawn and returned to the neutral position by the spring par 52. The use of a solenoid 14 or similarly driven system permits the imparting of therapeutic force without any extended pressure. The benefit of the invention is obtained by the acceleration of the reciprocating rod 16, and then permitting the reciprocating rod 16 to bounce or recoil on impact of the impact head 70 with the patient without any persistent pressure on the patient. In the preferred embodiment, acceleration is complete prior to impact. Extended pressure of any duration increases the likelihood of bruising. Avoiding extended pressure also permits higher levels of impact to be used without causing the patient pain.

When the power source 22 is engaged via the switch 28, the solenoid 14 impels the reciprocating rod 16 forward to impact the patient. When the solenoid 14 is turned off or deactivated, the reciprocating rod 16 returns to the neutral position as determined by the spring pair 52. The device may be set to provide for a single impact in activation, or with the use of a relay or similar circuitry 24, a rate of impact may be established and adjusted by sequentially activating and deactivating the solenoid 14 once the power source is engaged. The switch 28 may be variable such that rate of impact increases with pressure on the switch 28, or a second switch or dial (not shown) may be used to adjust the rate of impact. Such second switch may be located at the point of the outport 34 or another convenient location.

Affixed to the forward end 18 of the reciprocating rod 16 is a coupler. The coupler is used for affixing impact heads 70 of varying shapes. In the preferred embodiment the coupler is formed so as to permit the impact head 70 to be removably affixed to the reciprocating rod 16 at a set, but adjustable angle. This is accomplished through the use of a sleeve element 64 on the impact head 70. The coupler is comprised of a collar 62 affixed to the reciprocating rod 16, a collar pin 66 set on the collar 62 and pin notches 68 set in a sleeve base 67 of the sleeve element 64. The collar 62 is mounted on the reciprocating rod 16 offset from the forward end 18 so as to permit the sleeve element 64 of the impact head to receive a portion of the forward end 18 of the reciprocating rod 16 for stability. The sleeve base 67 abuts the collar 62 and the collar pin 66 is received into one of a number of defined pin notches 68 on the sleeve base 67 so as to prevent rotation of the impact head 70. A simple retaining hook or loop 72 or similar means retains the impact head 70.

Depending on the positioning of the annular ring 58 on the reciprocating rod 16, and the relative compression of the spring pair 52, the reciprocating rod 16 is driven forward and forces one of the impact heads 70 mounted thereon to contact the person being treated at any of a range of rates, travels and force levels. The single or continuous series of impacts provides therapeutic treatment to the person being treated.

While the invention has been illustrated and described in detail in the drawings and the foregoing description, the same is to be considered as illustrative and not restrictive in character, it being understood that only the preferred embodiment has been shown and described fully and that all changes and modifications that come within the spirit of the invention are desired to be protected.

I claim:

1. An impact tool comprising:

a housing containing a impact assembly, said impact assembly comprising:

an axially reciprocating rod, said reciprocating rod operatively connected to an impelling means, said reciprocating rod having disposed on one end a coupler for adjustably affixing a one or more impact heads at one or more angles of impact, wherein said coupler is comprised of:

a collar affixed to said reciprocating rod proximate a forward end of said reciprocating rod, said collar set with a collar pin, a sleeve element disposed within said one or more impact heads for insertably receiving said forward end of said reciprocating rod, a sleeve base affixed to said sleeve element to abut said collar, an at least one pin notch placed in said sleeve base for receiving said collar pin, a means to removably secure said one or more impact heads to said reciprocating rod.

2. An impact tool, comprising:

a housing with an inner surface and an outer surface, an impact assembly disposed within said housing, said impact assembly being operatively connected to a power source, with said impact assembly comprising a reciprocating rod transiting said housing with an adjustable stop and an impelling means operatively connected to said reciprocating rod, and a coil spring pair, wherein said coil spring pair is comprised of a forward spring disposed around said reciprocating rod and a rearward spring disposed around said reciprocating rod, said forward spring being biased against said adjustable stop and against the inner surface of the housing on the rearward side, said rearward spring biased against the outer surface of the housing and fitted against a threaded annular head, said threaded annular head being affixed to said reciprocating rod.

3. The impact tool of claim 2 wherein said rearward spring is of a heavier gauge than said forward spring.

* * * * *